United States Patent [19]

Pryor

[11] Patent Number: 5,052,686

[45] Date of Patent: Oct. 1, 1991

[54] TENNIS NET AND METHOD OF MAKING

[75] Inventor: Douglas E. Pryor, Dallas, Tex.

[73] Assignee: Sport Supply Group, Inc., Farmers Branch, Tex.

[21] Appl. No.: 510,963

[22] Filed: Apr. 19, 1990

[51] Int. Cl.[5] ..... A63B 61/00

[52] U.S. Cl. ..... 273/29 B

[58] Field of Search ..... 273/29 B, 29 R, 29 BB, 273/29 BC

[56] References Cited

U.S. PATENT DOCUMENTS 2,257,634 9/1941 Bunker ..... 273/29 B 3,689,067 9/1972 Bramley ..... 273/29 B

*Primary Examiner*—Theatrice Brown

*Attorney, Agent, or Firm*—David H. Judson

[57] ABSTRACT

A tennis net according to the present invention includes a length of netting having a top edge, a bottom edge, a first side edge and a second side edge, with the side edges of the netting being spaced apart from each other and joining the top edge to the bottom edge. A headband of preferably thermoplastic material is folded upon itself longitudinally to enclose a portion of the top edge of the netting and then welded to itself in a predetermined manner to retain the headband on the netting.

5 Claims, 1 Drawing Sheet

TENNIS NET AND METHOD OF MAKING

TECHNICAL FIELD

The present invention relates generally to tennis net construction and more particularly to a tennis net formed by heat sealing a headband to a net and providing reinforced ends to increase the useful life of the product during use.

BACKGROUND OF THE INVENTION

Numerous tennis net constructions are well-known in the prior art. Generally, such nets are formed by repeatedly applying the netting and a vinyl headband to a double needle sewing machine to stitch the headband to the netting. Suitable lacing grommets are then affixed at each end of the net. Such prior art constructions suffer unacceptable failure rates due primarily to weathering and deterioration of the stitches themselves caused by their being repeatedly struck by the tennis ball during use. Moreover, even the manufacturing process used to make such nets contributes to their eventual failure. This is primarily because the stitching needles used to stitch the headband to the netting often distort the vinyl, thus weakening the stitched seams and subjecting them to shear failure.

One suggestion to solve these problems was provided in U.S. Pat. No. 3,689,067 to Bramley. This patent described a tennis net construction wherein the headband was essentially welded to the netting at selective locations along the net. This construction obviated the use of stitching and did provide certain useful improvements over the prior art. The Bramley net construction, however, was difficult to manufacture due to the need to selectively weld the vinyl at predetermined locations. The selective placement of welding was also undesirable and contributed to failure because the stress of the metal cable drawn through the net could not be evenly distributed along the net length.

There is therefore a need to provide new and useful tennis net constructions and methods of manufacture that overcome these and other problems associated with the prior art.

BRIEF SUMMARY OF THE INVENTION

It is an object of the present invention to provide a tennis net construction that is simple and inexpensive to manufacture and is highly resistant to damage due to weathering and other environmental factors.

It is another object of the invention to provide a substantially stitchless tennis net having a headband that will not separate from the netting during normal wear and usage of the net.

It is a further object of the present invention to provide an improved tennis net construction wherein a headband is welded to a netting along substantially its entire length and then folded in on itself along each edge thereof to facilitate the production of reinforced ends.

It is still another object of the present invention to describe a simple and reliable method of manufacturing tennis nets which are sturdy and reliable and will not deteriorate during normal usage.

These and other objects of the invention are provided in a tennis net construction comprising a length of netting having a top edge, a bottom edge, a first side edge and a second side edge, with the side edges of the netting being spaced apart from each other and joining the top edge to the bottom edge The net also includes a headband comprising thermoplastic material folded upon itself longitudinally to enclose a portion of the top edge of the netting and welded to itself along substantially its entire length to retain the headband on the netting. According to the invention, each end of the headband includes first and second non-welded sheets folded in on themselves and stitched to create a reinforced construction.

In accordance with yet a further feature of the invention, a method is providing for manufacturing a tennis net comprising the steps of:

providing a length of netting of flexible non-metallic threads disposed in a rectilinear mesh;

providing a band having thermoplastic material on at least one face thereof;

relatively positioning the band adjacent an edge of said length of netting;

folding said band laterally upon itself to enclose at least part of a top edge of the length of netting;

welding said band to itself along substantially the length of netting while leaving each end of the netting with un-welded first and second sheets;

folding the first and second sheets of each end upon themselves to create a plurality of layers; and stitching the plurality of layers to create reinforced edges.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 1:
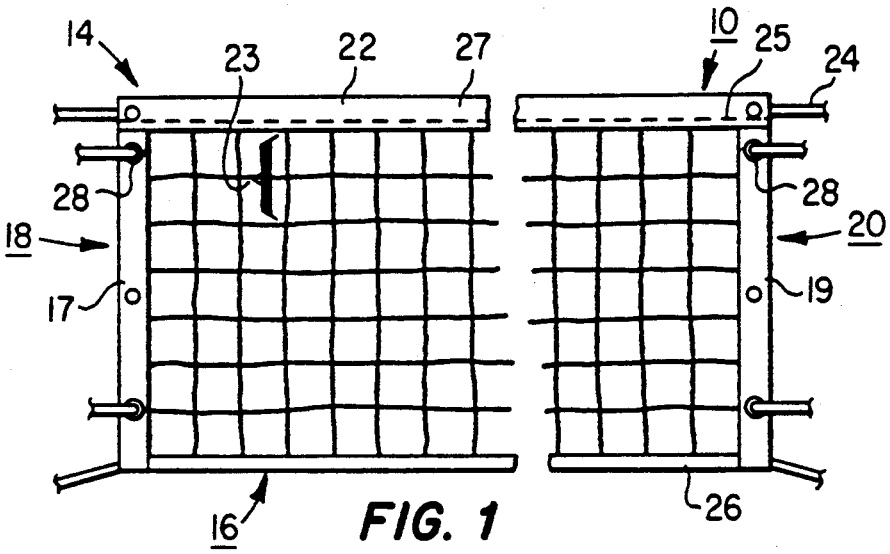
FIG. 1 is a side view of a tennis net constructed according to the principles of the present invention.

Referring now to FIG. 1, a tennis net 10 manufactured according to the present invention includes a length of netting 12 having a top edge 14, a bottom edge 16, a first side edge 18 and a second side edge 20, with the side edges 18 and 20 of the netting 12 being spaced apart from each other and joining the top edge to the bottom edge. A headband 22, preferably formed of a vinyl-coated nylon or other thermoplastic material, is secured to the netting by the method to be described below. The headband partially encloses a supporting cable 24 along the top edge 14 of the net 10. A footband 26 may also be provided on the bottom edge 16 of the net and marginal edge bands 17 and 19 for the first and second side edges 18 and 20 may also be provided. The supporting cable is made of a non-elastomeric material, preferably metal. Each edge of the net preferably includes a grommet 28 through which reinforcing wires or cables are drawn to further increase the rigidity of the net during use.

The netting is preferably braided, knotless nylon or polyethylene, and is weather treated for ultraviolet and moisture protection. As noted above, preferably the headband 22 is formed of a nylon-reinforced polyester material which is vinyl-coated. If desired, the first several rows 23 of netting adjacent the top edge 14 may include double rows of material because this area obtains the greater stress during use. The marginal edge and footbands are preferably tapes of vinyl-coated nylon.

Figure 2:
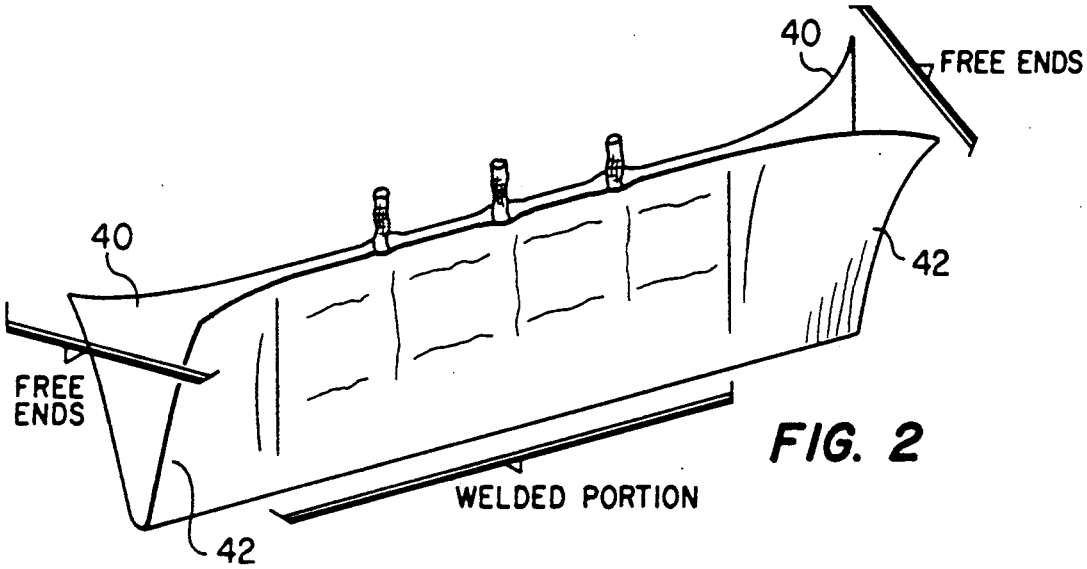
FIG. 2 is a schematic diagram of the tennis net of FIG. 1 following the step of sealing the headband to the knitting.
Figure 3:
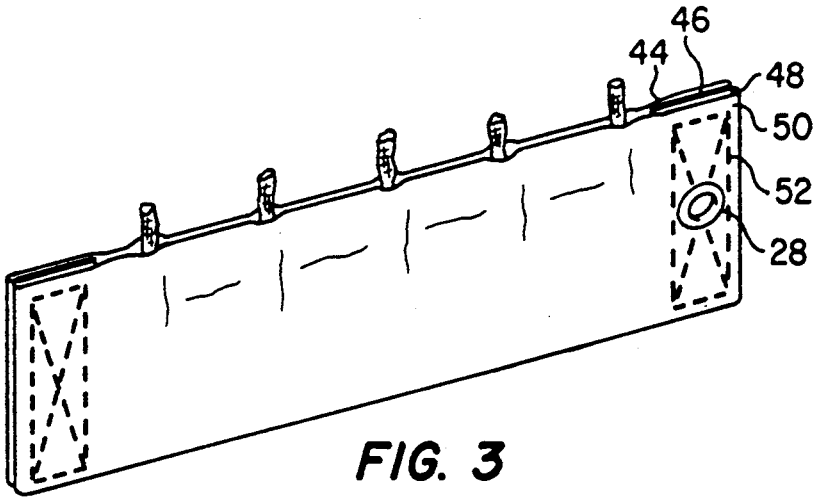
FIG. 3 is a schematic diagram of the tennis net after the ends of the net are folded in on themselves to create a multi-layer reinforced construction.

The problems associated with prior art stitched tennis net constructions are overcome by the present invention wherein the headband 22 is welded to the netting 12 along substantially its entire length and then folded in on itself along each edge thereof to facilitate the production of reinforced ends. Preferably, but not by way of limitation, the tennis net described above with respect to FIG. 1 is manufactured using a rotary welding machine of the type manufactured by Hapco, Inc. under the Model No. MHA. According to the method, the netting 12 and the (unfolded) headband are feed to the folder unit of the machine which serves to fold the headband around the netting. After folding, the folded headband/netting assembly is drawn through a welding assembly of the machine wherein a hot air stream melts or "vulcanizes" the headband to itself along a longitudinal seam 25, thereby trapping the netting therein. A looped (upper) end 27 of the headband, however is not treated and thereby remains unsealed for the purpose of receiving the cable 24 therein. The ends of the net are also left untreated. Of course, other methods of welding the headband to the netting, such as RF welding, can be used After the welding step, each end of the headband of the net schematic includes two free sheets 40 and 42 substantially as shown in the bottom view of FIG. 2. Thereafter, according to the present invention, each of the sheets 40 and 42 is folded back on itself to create four layers 44, 46, 48 and 50 as shown in FIG. 3. This reinforced edge is then stitched with suitable heavy duty thread 52. The lacing grommet 28 is then affixed in the reinforced edge to complete the construction.

The method of the present invention thus produces a tennis net wherein substantially the entire length of the headband is welded to the netting to overcome the problems associated with prior art stitched constructions. The ends of the net are also reinforced through the double-backed headband construction to enhance the durability of the net at the points of greatest stress; namely, the ends or the net where the metal cable is drawn through.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. A net particularly adapted for use as a tennis net, comprising:

a length of netting having a top edge, a bottom edge, a first side edge and a second side edge, with the side edges of the netting being spaced apart from each other and joining the top edge to the bottom edge;

a headband having first and second ends comprising thermoplastic material and being folded upon itself along its longitudinal axis and separated along said axis a predetermined distance from each said end to form a pair of free ends at each end thereof, said headband having a medial section enclosing said top edge of the netting along the length thereof and to form a channel for receiving a net support cable and welded along substantially the length of the netting to retain the medial section of the headband on the netting;

said headband being unwelded at said free ends and said free end being folded in on themselves and secured to create a reinforced construction; and each of said side edges of said netting having one of its ends attached to a respective first and second end of said reinforced construction.

2. The net as described in claim 1 wherein the headband is formed of a vinyl-coated nylon material.

3. The net as described in claim 1 wherein the netting is formed of nylon.

4. The net as described in claim 1 further including a lacing grommet mounted in each end of the headband.

5. A method of making a net particularly adapted for tennis, comprising the steps of:

providing a substantially rectangular netting of flexible non-metallic threads disposed in a rectilinear mesh;

providing an elongated band having thermoplastic material on at least one face thereof;

positioning the band adjacent an elongated edge of said length of netting;

folding portion of said band along its longitudinal axis upon itself at least part of said elongated edge of the netting;

separating said folded portions along said longitudinal axis a predetermined distance from each end of said band to form a pair of free ends at each end thereof;

welding said folded portion of the band to said netting along substantially the length of said netting while leaving said free end of the netting unwelded;

folding said free end upon themselves to form a plurality of layers; and stitching the plurality of layers to form reinforced edges of said band.

* * * * *